US005229747A

United States Patent [19]

Zhao

[11] Patent Number: 5,229,747

[45] Date of Patent: Jul. 20, 1993

[54] TAMPERPROOF LOCK

[76] Inventor: Mantang Zhao, Second Floor, One W. Hoffman Ave., Cherry Hill, N.J. 08002

[21] Appl. No.: 867,506

[22] Filed: Apr. 13, 1992

[30] Foreign Application Priority Data

Nov. 29, 1991 [CN] China ..... 91109818

[51] Int. Cl.[5] ..... E05B 45/08; E05B 17/20; E05B 9/04

[52] U.S. Cl. ..... 340/542; 70/1.5; 70/380; 70/416; 70/422

[58] Field of Search ..... 340/542; 70/DIG. 49, 70/374, 379 R, 379 A, 380, 422, 416, 461, 419, 1.5

[56] References Cited

U.S. PATENT DOCUMENTS

| | | | |
|---|---|---|---|
| 2,049,742 | 8/1936 | Lowe | 70/422 |
| 2,317,904 | 5/1967 | Clay | 340/542 |
| 3,550,410 | 12/1970 | Toepfer | 340/542 |
| 3,962,695 | 6/1976 | Peters | 340/542 |
| 4,035,791 | 7/1977 | Katayama | 340/542 |
| 5,152,161 | 10/1992 | Lee | 70/379 R |

*Primary Examiner*—Glen R. Swann, III
*Attorney, Agent, or Firm*—Norman E. Lehrer

[57] ABSTRACT

A pin tumbler lock barrel assembly is capable of preventing the lock from being operated by the use of a skeleton key or any other tool inserted into the key slot. The lock is comprised of an improved hollow lock casing having a key plug located therein and a specially designed sleeve that surrounds the lock casing that is relatively rotatable with respect thereto. The sleeve is comprised of two halves that are interconnected by spring-loaded fasteners. A crescent-shaped slot is provided on the key plug and is aligned with two radial through bores formed in the lock casing and one of the sleeve halves. An alarm system includes a switch assembly on the periphery of the sleeve which is aligned with the radial bore. A specially designed sliding element with a cam-shaped end surface cooperates with the lock casing allowing only the correct key to operate the lock mechanism.

12 Claims, 2 Drawing Sheets

TAMPERPROOF LOCK

BACKGROUND OF THE INVENTION

The present invention relates to a pin tumbler lock assembly and more particularly to a lock barrel assembly capable of preventing the lock from being operated by a skeleton key or other tool inserted into the key slot.

Conventional pin tumbler lock assemblies have wide application and are extensively used. Such locks, however, can be easily picked by an experienced burglar or by a locksmith. These locks, therefore, do not provide for much security or safety. There has, therefore, been much effort in the past to improve such locks so as to make them useful for safes, slot machines, automobiles and other apparatuses requiring security.

DESCRIPTION OF THE PRIOR ART

Chinese Patent Application No. 88214575.4 discloses a lock with an alarm means wherein the alarm switch is positioned adjacent the rear end of the key plug and which has a switch base and an actuating arm inserted into the key slot at a distance from the rear end. A notch complementary to the actuating bar must be formed on the correct key so that only the correct key can be used when operating the lock and the key will not trigger the alarm. The actuating bar will be moved to trigger the alarm only if an incorrect key or other tool is inserted into the key slot.

British Application No. GB2055951A discloses a lock barrel operated by a special key. In addition to conventional mechanical lock barrel elements, it comprises a microswitch with a turning arm including a magnetic yoke, sensing elements, an electric controller circuit and an alarm means. The lock barrel can only be operated by a proper key which is made to be difficult to copy.

A locking device having a locking code is disclosed in U.S. Pat. No. 4,317,156. The device disclosed in this patent is operated by a special key and includes a means for reading the locking code on the key. A comparator and pulse generator are provided to insure that the device is unlocked only when the correct key is used. Japanese Application No. JP63-153781 discloses a similar type of locking device for use with automobiles.

Known tamperproof alarm locking devices are based on conventional mechanical locks and use supplemental code reading devices and specially formed keys. They are, however, not believed to be particularly useful since, for example, the actuating bar of the Chinese application can be observed through the key slot. And while the locking devices of the other three disclosures may have a high degree of confidence, they require the use of many electrical controlling elements. This results in relatively large lock sizes and increases the cost thereof.

The known tamperproof locking devices are comprised of numerous complex parts with keys that must be specifically designed. They are, therefore, relatively expensive. Furthermore, these known devices are not capable of preventing the lock from operating if the key slot is forced to rotate. This may cause the device to unlock without triggering the alarm.

SUMMARY OF THE INVENTION

It is an object of the present invention to overcome the above disadvantages of the prior art by providing a tamperproof lock barrel assembly capable of effectively preventing the lock from operating by an incorrect key or other device or by an external force.

It is another object of the present invention to provide a tamperproof lock barrel assembly having an alarm means. The tamperproof lock of the invention is reliable, simple in construction and is easily made at a very low cost.

A conventional pin tumbler lock barrel assembly is comprised essentially of a key plug and a lock casing. The present invention, on the other hand, is comprised of a key plug and lock casing and an outer sleeve which will be explained more fully hereinafter. The present invention utilizes a substantially conventional pin tumbler lock operated by a normal key.

The lock barrel assembly comprises a hollow lock casing having a longitudinal axis and includes a plurality of pin tumbler bores intersecting therewith. A key plug having a cylindrical portion received within the hollow lock casing contains an axially extending key slot and pin tumbler bores which are aligned with those of the lock casing. A sleeve comprised of two sleeve halves surrounds a portion of the outer periphery of the lock casing and is rotatable relative to the lock casing. The rotational friction between the sleeve and the lock casing is adjustable by fasteners that interconnect the sleeve halves. This friction is set to be greater than the friction between the lock casing and the key plug.

The lock casing and one of the sleeves are provided with radially extending through bores which are aligned with each other. Two pin tumblers which are arranged in a row are received therein. The pin tumblers do not block the relative rotation between the sleeve and the lock casing when in a first position. The key plug also has a crescent-shaped slot formed on the outer periphery thereof. The crescent slot is aligned with the radial bores.

An alarm switch is located on the outer peripheral surface of the sleeve and is aligned with the radial bore of the sleeve. The alarm switch is comprised of a movable insulated plate having two elongated holes extending in a longitudinal direction. This plate is mounted on the sleeve by fasteners passing through these elongated holes. The plate is forced toward the periphery of the sleeve by springs. One end of the plate engages another spring to bias it rearwardly and the other end includes a cam shape thereon.

Adjacent the spring-loaded end of the plate is a cam follower secured by a leaf spring to a portion of the sleeve. A ratchet tooth is formed on the side of the insulating plate which can be brought into engagement with the cam follower at the free end of the leaf spring so as to retain the plate in position when the same is axially moved toward its spring-loaded end. As this movement occurs, it causes the cam follower at the free end of the leaf spring to pass over the ratchet tooth where it retains the insulated plate in place. An electric contact of an alarm switch is located on the insulated plate and triggers an alarm when the contact is brought into touch with the sleeve by the axial movement of the plate.

Mounting holes are provided on only one of the two sleeve halves. As a result, the friction between the two sleeve halves and the lock casing is not dependent on the manner in which the sleeve is mounted to a support surface or the like.

The inner end of the key plug has a sliding element carrying a switch tripping member. This member is axially slidable with respect to the key plug but is mounted so as not to be rotatable relative to the same. The end faces of the slider and the lock casing face each other and are respectively shaped to form cam surfaces. These cam surfaces are urged together by a spring. There is an approximately 10–30 degree circumferential clearance between the cam surfaces of the slider and lock casing.

Use of the correct key will allow the key plug to rotate relative to the lock casing so as to operate the lock while the lock casing is maintained in position by the sleeve. Use of an improper key (or other tool inserted into the key slot), will cause the lock casing to rotate together with the key plug relative to the sleeve. This rotation will not operate the lock but will trigger the alarm.

The lock barrel assembly of the present invention has numerous advantages over the prior art. Most significantly, it prevents the lock barrel from being twisted by the use of an external force to operate the lock. It also includes no way for a thief to tell the difference between a correct key and an incorrect key by simply turning the key. This substantially enhances the security and deterrence of the lock since the thief will not be given an opportunity to try a second time. The first try with the incorrect key will trigger the alarm which cannot be shut off without the use of the correct key. The present invention is also simple in construction and is reliable. It utilizes conventional keys and also permits the use of many parts of a conventional pin tumbler lock assembly.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
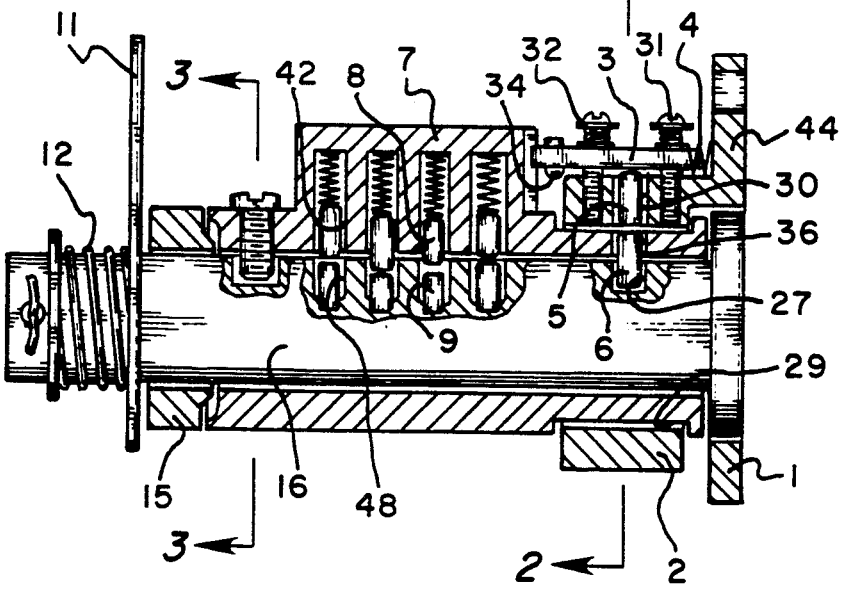
FIG. 1 is a longitudinal cross-sectional view of a tamperproof lock constructed in accordance with the principles of the present invention.

Referring now to the drawings in detail, wherein like reference numerals have been used throughout the various figures to designate like elements, there is shown in FIG. 1 a tamperproof lock assembly constructed in accordance with the principles of the present invention. The lock assembly of FIG. 1 is comprised of a key plug 16, a hollow lock casing 7 which receives the key plug and a sleeve 44 surrounding a portion of the outer periphery of the lock casing 7. The lock casing 7 is relatively rotatable with respect to the sleeve 44.

Figure 2:
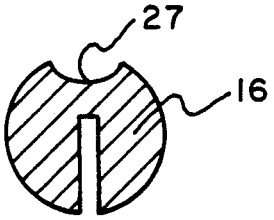
FIG. 2 is a cross-sectional view of the key plug taken along the line 2—2 of FIG. 1.
Figure 3:
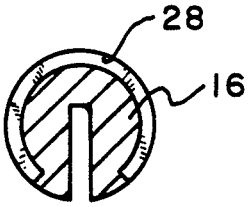
FIG. 3 is a cross-sectional view of the key plug taken along the line 3—3 of FIG. 1.

As will be explained more fully hereinafter, the sleeve 44 is formed by an upper sleeve half 1 and a lower sleeve half 2. The sleeve halves 1 and 2 are interconnected by fasteners 24 and 25 (see FIGS. 6 and 7) and, as shown in FIG. 1, include portions which fit within annular groove 29 provided on the outer peripheral surface of the lock casing 7. The upper sleeve half 1 and the lock casing are also provided with radial through bores 30 and 36, respectively, which are aligned with each other and which receive therein two pin tumblers 5 and 6, respectively, which are in series with each other. The pin tumblers 5 and 6, when in the normal position allow for relative rotation between the sleeve 44 and the lock casing 7. The key plug 16 has a crescent-shaped slot 27 formed therein as shown in FIG. 2. The slot 27 extends peripherally and is aligned with the through bores 36 and 30.

The lock casing 7 includes a longitudinally extending axis an includes pin tumbler bores 42 intersecting this axis. The key plug 16 is received in the hollow lock casing 7 and contains an axially extending key slot and pin tumbler bores 48 which are aligned with the pin tumbler bores of the lock casing 7. A set of pin tumblers 8 and 9 are arranged in series in the aligned bores 42 and 48, respectively, and are spring biased toward the central axis of the key plug 16.

A sliding element 15 is mounted on the inner end of the key plug 16. Element 15 is mounted so as to be axially slidable with respect to the key plug 16 but cannot rotate relative thereto. A switch-tripping member 11 is also mounted on the key plug 16 behind the sliding element 15. As will be seen, the switch-tripping member 11 is used for transmitting key plug rotation to a secondary locking mechanism (not shown). The end face 15A of the sliding element 15 and the end face 7A of the lock casing 7 which face each other are formed with cooperating cam surfaces which are kept in contact with each other by a compression spring 12.

Figure 4:
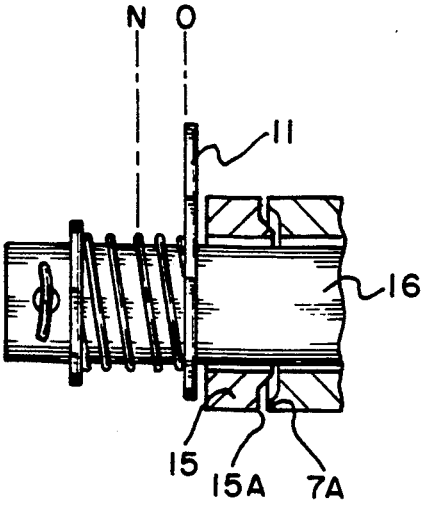
FIG. 4 is a partial sectional view showing a first position of the slider element when there is no rotational movement between the key plug and the lock casing.
Figure 5:
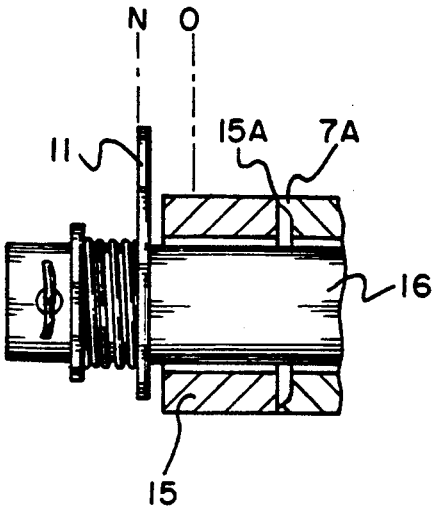
FIG. 5 is a view similar to FIG. 4 but showing a second position of the slider when there is relative rotation between the key plug and the lock casing.

As shown in FIGS. 4 and 5, the switch-tripping member 11 is in position O when the lock is in its locked condition. When the key plug 16 is rotated through the use of a proper key, sliding element 15 also rotates therewith and, as a result of the cooperating cams between the element 15 and the lock casing 7, element 15 moves axially rearwardly as shown in FIG. 5. As the sliding element 15 moves rearwardly, it carries the switch-tripping member 11 with it until the same is in the position N as shown in FIG. 5. The secondary locking mechanism (not shown) will be located at location N so that the same can be activated by the switch-tripping member 11.

Figure 6:
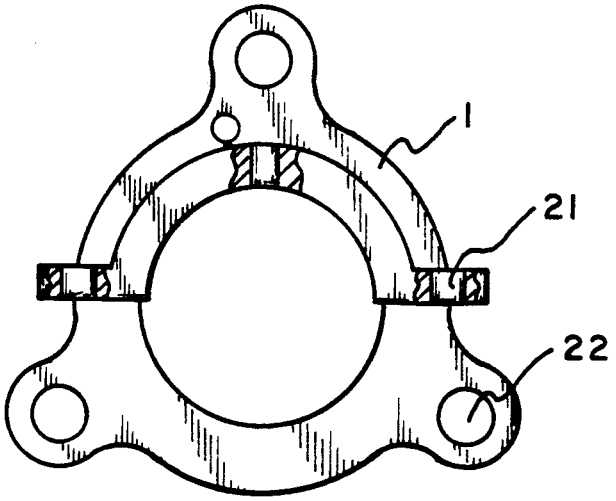
FIG. 6 is an elevational view taken from the rear of the upper sleeve half.
Figure 7:
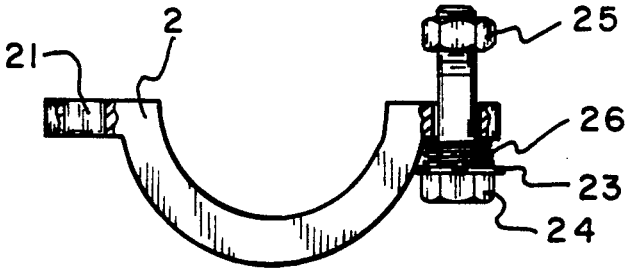
FIG. 7 is a similar view of the lower sleeve half.

As shown in FIGS. 6 and 7, mounting holes 22 are formed only on sleeve half 1. Each of the sleeve halves 1 and 2, however, are provided with connecting means including holes 21 which extend vertically therethrough. Bolts 24 pass through these holes to join the sleeve halves 1 and 2 together through the use of cooperating lock nuts 25. Springs 26 and washers 23 are provided on the bolts 24 so that the frictional force between the outer surface of the lock casing 7 and the inner surface of the sleeve 44 can be adjusted by adjusting the nuts and bolts 24 and 25. For the reasons that will be clearer hereinafter, the rotational friction between the lock casing 7 and the sleeve 44 is set to be greater than the rotational friction between the key plug 16 and the lock casing 7.

Figure 8:
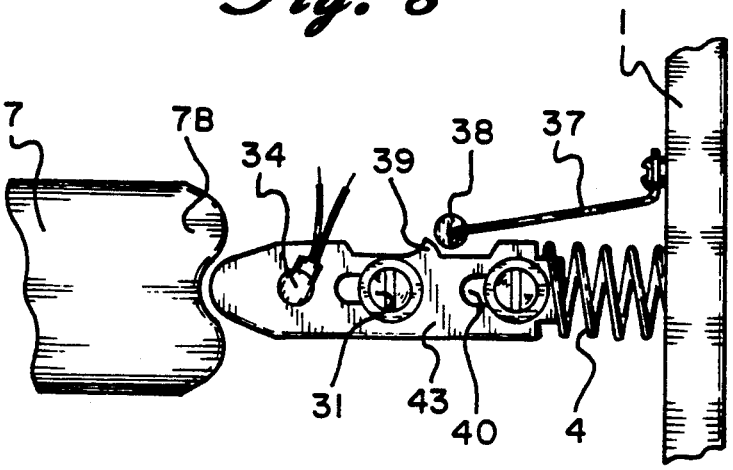
FIG. 8 is a partial plan view of the alarm assembly of the invention.

Referring now to FIGS. 1 and 8, it can be seen that an alarm switch means 3 is mounted on the outer peripheral surface of the upper sleeve half 1 overlying radial bore 30 formed in the sleeve. An axially movable elongated insulated plate 43 is mounted on the sleeve 44 by screws 31 which pass through elongated slotted holes 40. Screws 31 are each provided with a compression spring 32 in order to bias the plate 43 radially inwardly. The forward end of the plate 43 carries a spring 4 which biases the plate 43 rearwardly. The rearwardmost end of the plate 43 includes a cam-shaped surface.

A ratchet tooth 39 is formed on one side of the insulated plate 43. A cam follower in the form of a roller 38 is carried at the end of leaf-spring 37 which is mounted to the sleeve half 1. Roller 38 engages the side of the plate 43 and, as the plate 43 is moved forwardly against the force of spring 4, the roller 38 passes over the ratchet tooth 39 to engage the ratchet tooth and maintain the plate 43 in its forward position. It should be readily apparent that the roller 38 could be replaced by a hook formed on the free end of the leaf spring 37.

Adjacent the free or cam-shaped end of the insulated plate 43 is a portion of the lock casing 7. This portion of the lock casing 7 is also shaped to form a cam surface 7B which cooperates with the cam surface of the plate 43.

An electrical contact 34 which forms part of the alarm switch means 3 is mounted on the insulated plate 43 adjacent the free end thereof. As shown in FIG. 1, the electrical contact 34 extends below the lower surface of the plate 43. With appropriate circuitry (not shown) the electrical contact 34 will trigger an alarm when the contact 34 is brought into engagement with a portion of the sleeve 44 when the insulated plate 43 is moved forwardly against the force of spring 4.

Once the alarm means has been activated, it cannot be switched off because the insulated plate 43 had been moved sufficiently forward to bring the roller 38 of the leaf spring 37 into engagement with the ratchet tooth 39. This engagement can only be released when the insulated plate 43 is lifted upwardly by the upward movement of pin tumblers 5 and 6. However, the pin tumblers 5 and 6 will not move upwardly without the use of the proper key in the lock.

The lock of the present invention operates in the following manner. When a correct key is inserted into the key plug 16, the pin tumblers 8 and 9 in the bores 42 and 48 will not block the key plug 16 in casing 7 from relative rotation with respect to each other. And since the rotational friction between the sleeve 44 and the lock casing 7 is greater than the friction between the lock casing 7 and the key plug 16, turning of the correct key will cause the key plug 16 to rotate with respect to the lock casing. As a result, the pin tumbler 6 is lifted by the crescent-shaped slot 27 to enter into the bore 30 of the sleeve 44 to thereby prevent relative rotation between the lock casing 7 and sleeve 44. The upward movement of the pin tumbler 6 also forces the insulated plate 43 upwardly so as to release the contact 34 from the sleeve 44 if the alarm was on.

Because of the existence of the circumferential clearance between the cam surfaces of sliding element 15 and lock casing 7, the key plug 16 rotates relatively easily with respect to the lock casing 7 allowing the pin tumbler 6 to rise to enter into the bore 30 of the sleeve 44 before an enlarged torque is generated which might cause the lock casing 7 to rotate with respect to the sleeve 44.

As the correct key continues to be turned, the cam surfaces 7A and 15A of the lock casing 7 and sliding element 15, respectively, will be brought into engagement with each other to force the sliding element 15 and switch-tripping element 11 rearwardly away from the lock casing 7. Eventually, the switch-tripping member 11 is moved into position N to operate the secondary locking mechanism.

When an incorrect key or other tool is inserted into the key plug 16 and turned, it will cause the lock casing 7 to rotate together with the key plug 16 relative to the sleeve 44. This occurs since the pin tumblers 8 and 9 are not brought into proper registry to permit the key plug 16 to be rotated with respect to the lock casing 7. Furthermore, the pin tumbler 6 is not pushed upwardly into the bore 30 to hold the lock casing 7 and the sleeve 44 with respect to each other. Because there is no relative rotation between the sliding element 15 and the lock casing 7, the switch-tripping member 11 will remain in position O. As a result, it will not engage the secondary locking mechanism located in position N whereby the lock will not be operated.

With rotation of the lock casing 7 together with the key plug 16 caused by the use of an incorrect key, the cam surface 7B of the lock casing 7 will be brought into contact with the cam-shaped end of the insulated plate 43 thereby pushing the plate axially forwardly against the force of spring 4. As the plate 43 continues to be moved forwardly, the roller 38 mounted at the end of the leaf spring 37 engages the ratchet tooth 39 of the plate 43 and holds the plate in position where the electrical contact 34 is maintained in contact with the sleeve 44 to trigger the alarm. The alarm cannot be turned off once it is set even if the incorrect key is turned back in the reverse direction.

The proper amount of rotational friction between the sleeve 44 and the lock casing 7 is set by adjusting the nuts 25. This friction should be set high enough so that the lock casing 7 will not rotate when key plug 16 is rotated utilizing the proper key but should not be set so high that a thief will be able to tell the difference between the torque needed to operate the lock utilizing the correct key and the torque needed to set off the alarm utilizing an incorrect key. Because all of the mounting holes 22 are provided on only one of the sleeve halves, the friction between the sleeve 44 and the lock casing 7 is independent of the manner in which the lock is mounted on a support surface or the like.

Once the alarm is triggered, it can only be turned off by the use of the correct key. This is accomplished by first inserting a portion of the key blade into the key plug 16 and turning the key plug 16 back to its original position to align the pin tumbler 6 with the bore 30. The entire correct key is then inserted into the key plug 16 and the key is turned as if operating the lock in a normal manner. When this occurs, the pin tumblers 5 and 6 are moved upwardly to lift the insulating plate 43 thereby disengaging the roller 38 from the ratchet tooth 39. The insulating plate 43 is then pushed back to its original position by the force of spring 4 to move the contact 34 away from the sleeve 44 to thereby turn off the alarm.

The present invention may be embodied in other specific forms without departing from the spirit or essential attributes thereof and accordingly reference should be made to the appended claims rather than to the foregoing specification as indicating the scope of the invention.

I claim:

1. A tamperproof lock comprising:

(a) a lock casing including a plurality of radially extending tumblers therein;

(b) a key plug within said casing, said key plug including a plurality of radially extending tumblers adapted to cooperate with the tumblers of said lock casing, said key plug being adapted to rotate relative to said lock casing when a correct key is inserted therein and turned;

(c) an outer sleeve means surrounding a portion of said lock casing, said sleeve means frictionally engaging said lock casing but allowing at least a limited degree of relative rotation between said lock casing and said sleeve means, and means for adjusting the frictional force between said lock casing and said sleeve means.

2. The lock as claimed in claim 1 wherein said sleeve means is comprised of two parts interconnected by adjustable fasteners.

3. The lock as claimed in claim 2 further including means for sensing relative rotation between said lock casing and said sleeve means and means responsive thereto to initiate an alarm.

4. The lock as claimed in claim 3 wherein said sensing means includes a switch element moveable between an inoperative position when there is no relative rotation between said lock casing and said sleeve means and an operative position when there is such relative rotation.

5. The lock as claimed in claim 4 further including means for maintaining said switch element in said operative position.

6. The lock as claimed in claim 5 wherein said maintaining means includes a cam follower and a ratchet tooth adapted to engage each other.

7. The lock as claimed in claim 6 further including means for disengaging said cam follower and ratchet tooth to thereby allow said switch element to return to its inoperative position.

8. The lock as claimed in claim 1 further including a sliding element coaxially mounted on said key plug, said sliding element cooperating with said key plug so as to rotate therewith but so as to be axially slideable relative to said key plug; said sliding element including a cam surface thereon engaging a portion of said lock casing and further including a spring means biasing said sliding element toward said casing, whereby, when said key plug and sliding element are made to rotate relative to said casing, said sliding element moves in an axial direction.

9. The lock as claimed in claim 8 further including a switch tripping member axially moveable with and extending from said sliding element.

10. The lock as claimed in claim 8 wherein said sliding element is mounted on said key plug adjacent the rear end thereof.

11. The lock as claimed in claim 10 wherein said cam surface on said sliding element faces axially forwardly.

12. The lock as claimed in claim 11 wherein said casing includes a rearwardly facing cam surface adapted to cooperate with said cam surface of said sliding element.

* * * * *